United States Patent [19]

Morel

[11] Patent Number: 4,898,293

[45] Date of Patent: Feb. 6, 1990

[54] CLOSING DEVICE FOR CONTAINERS

[75] Inventor: Simone Morel, Montmirail, France

[73] Assignee: Societe de Conseils et D'Etudes Des Emballages S.C.E.E., Dammartin en Goele, France

[21] Appl. No.: 202,572

[22] Filed: May 25, 1988

[30] Foreign Application Priority Data

May 25, 1987 [FR] France ..... 8707347
Oct. 28, 1987 [FR] France ..... 8714953

[51] Int. Cl.[4] ..... B65D 41/50

[52] U.S. Cl. ..... 215/250; 206/222; 222/83

[58] Field of Search ..... 215/250, 257; 206/222; 222/83, 81

[56] References Cited

U.S. PATENT DOCUMENTS 3,802,604 4/1974 Morane et al. ..... 206/222 X
4,465,183 8/1984 Saito et al. ..... 206/222
4,634,013 1/1987 Bar-Kokhba ..... 215/257 X
4,722,449 2/1988 Dubach ..... 215/250 X

FOREIGN PATENT DOCUMENTS 1117703 3/1956 France ..... 222/83

*Primary Examiner*—Donald F. Norton
*Attorney, Agent, or Firm*—Browdy & Neimark

[57] ABSTRACT

The closing device is provided for a container in which a cap is put in position on one end of the container forming a neck. The cap comprises an encasing portion for the container and a portion including opening and closing means. A membrane is sealed to a portion forming the neck of the container. A perforation member is placed in the vicinity of the membrane and provided for folding back this membrane toward walls of the neck. Means are arranged such that the perforation member can occupy a first position for which it cannot act on the membrane and at least a second position for which the membrane is broken and folded back.

17 Claims, 2 Drawing Sheets

CLOSING DEVICE FOR CONTAINERS

BACKGROUND OF THE INVENTION

The present invention relates to the closing of containers which can contain products of any sort such as food, cosmetic, medicamentous or chemical products and the like, these materials being indifferently in the form of liquids, powders, granulates or flakes.

It is known that most products which have to be preserved must be isolated from the atmosphere.

To this end, it is current in the art to seal the container containing the product by a membrane which can be made of aluminum, a synthetic material, an impregnated paper, etc.

The membrane is put in position and sealed to the container, possibly after having evacuated the container in order to avoid any oxidation of the product contained therein.

In order to protect the membrane and to allow consuming the product at different times, a cover is then placed on the container.

The hereabove mentioned and well known realizations necessitate, at the moment of use, removing the cover and then cutting out the protection membrane which, till then, was also used as a pilfer-proof element.

OBJECT OF THE INVENTION

The invention relates to an improved closing device which has all the qualities of the hereabove mentioned devices, but which enables moreover perforating the membrane without previously removing the cap and, consequently, without this membrane being soiled by some article.

Moreover, the device of the invention prevents membrane scraps from falling into the container, and this although the membrane leaves the container neck surface, which is free almost in totality when perforated.

Moreover, the invention, when carried into effect in a preferred embodiment, provides a double safety against pilferage, meaning that the user of the container having the device of the invention is sure that there is no possibility to access to the protection membrane as long as he has not himself removed a pilfer-proof element.

Moreover, the closing device of the invention has for its advantage to permit using caps of extremely various types, that is caps which can be opened or closed either by a pivoting, tipping or sliding movement. In other words, the cap which can be used can be, in all cases, the cap which is best adapted to a product contained in the container.

A particular embodiment of the invention enables storing, in a possibly sterile and air-sealed manner, two different products which can be mixed together in use while being kept sterile and protected from the ambiant air until the moment when they will be used.

SUMMARY OF THE INVENTION

According to the invention, the closing device for a container in which a cap is put in position on a neck of the container is such that the cap comprises a portion surrounding the neck and a portion including opening and closing means for the container, a membrane is sealed to a portion forming the neck of the container, and a perforation member is placed in the vicinity of the membrane and is carried by a partition of the cap, the partition having at least one hole, said perforation member being provided for folding back the membrane toward inner walls of the neck, and adjusting means being arranged such that the perforation member occupies a first position for which it cannot act on the membrane and at least a second position for which the membrane is broken and folded back in order to free a communication between the container and inside of the cap.

Various other features of the invention will become more apparent from the following detailed description.

BRIEF DESCRIPTION OF THE DRAWINGS

Embodiments of the invention are shown, by way of non limiting examples, in the accompanying drawings, wherein.

DETAILED DESCRIPTION OF THE INVENTION

Figure 1:
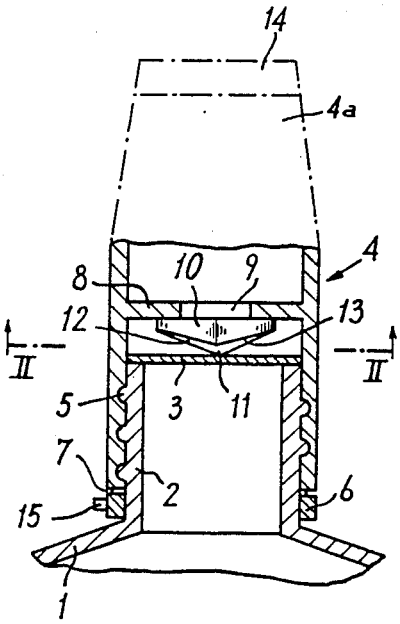
FIG. 1 is a partial cross-sectional elevation view of the closing device of the container of the invention.

In the drawings, reference numeral 1 designates a container which can contain a product of any sort, for example a food product, a cosmetic product, a medicamentous product, a chemical product, etc.

These products can be liquid, pulverulent or in the form of flakes or granulates.

The container 1 includes a neck 2 which is shown as having a section smaller than the remainder of the body of the container 1.

In order to protect the product contained within the container 1, the neck 2 is closed at its mouth by a membrane 3 which is sealed. The membrane 3 can be made of aluminum, a synthetic material, a paper impregnated or not, or any other suitable material, and it is put in position by any method known in the art, after having possibly evacuated the inside of this container. In addition to the membrane 3, the closing device includes a cap generally designated at 4, this cap having a side wall surrounding the neck 2 to which it is connected via connecting or engagement means 5, such as screw threads or cooperative bars, for opening and closing the container and for enabling the cap 4 to occupy at least two positions with respect to the neck 2.

The cap 4 is provided at its base with a removable band 6 connected to the cap 4 via a breaking element 7.

The removable band 6 comes in abutment against a protruding portion of the container 1, for example against the high portion of the body of the container 1, and the removable band 6 determines one of the positions that the cap 4 can occupy with respect to the container 1. Actually when the removable band 6 is in abutment, the connecting means 5 between the cap 4 and the container 1 are in engagement together.

Figure 3:
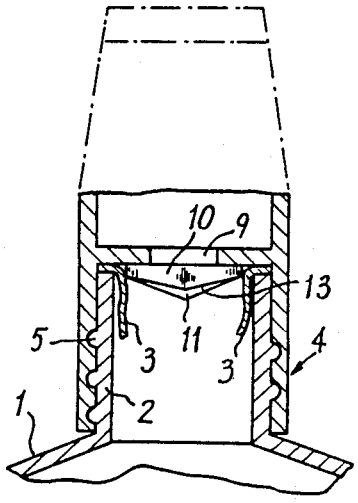
FIG. 3 is a cross sectional view similar to FIG. 1, illustrating the closing device of FIG. 1 in a position of use.
Figure 2:
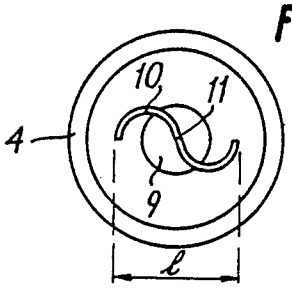
FIG. 2 is a schematic cross-sectional view, taken substantially along line II—II of FIG. 1.

The cap 4 is inside provided with a wall 8 formed with at least one hole 9. The wall 8 connects the body of the cap 4 to a perforation member 10 which, in the embodiment of FIGS. 1 and 2, is in the form of a blade substantially in the shape of an "S" with a width 1 (FIG. 2) being, for example, substantially equal to the inner diameter of the neck 2. As shown in FIGS. 1 and 3, the perforation member 10 has a point member 11 and sloping edges 12, 13. Dimensions of the perforation member 10 are chosen such that the perforation member 10 is at a small distance of, and even in contact with top of the sealed membrane 3, when the cap 4 is in position of no use on the container 1, that is when the removable band 6 is in abutment as shown in FIG. 1.

The upper portion 4*a* of the cap 4 can be made in any manner known in the art, for example so as to include a cover 14 with members whose opening is controlled by a rotary, sliding or pivoting movement. This portion of the cap 4 being not included within the object of the invention, will not be described in more detail and is, to this end, shown in phantom lines.

When one wishes to use the product contained within the container 1, or part of this product, one removes the removable band 6 by using for example a gripping tongue 15 possibly provided on the removable band, and one moves the cap 4 with respect to the container 1 so that the base of the cap 4 will come again in abutment as shown in FIG. 3. The displacement is produced by a screwing movement when the connecting means 5 are screw threads, or by a simple push if the connecting means 5 are cooperative bars or similar means. The removable band 6 thus acts as a control means for controlling the position of the perforation member 10.

The movement imparted to the cap 4 has for its effect that the point member 11 will perforate the membrane 3, and then that the sloping sides 12, 13 will fold the membrane 3 back against the flank of the neck 2. By rotating the cap 4 with respect to the neck 2, which is automatically obtained when the connecting means 5 are screw threads, one obtains a maximum opening of the membrane 3 without the membrane 3 falling in totality or in part within the container 1. The product contained in the container 1 can then be used by opening the cover 14 or by using fastenings of any other kind which are provided on the cap 4.

Figure 5:
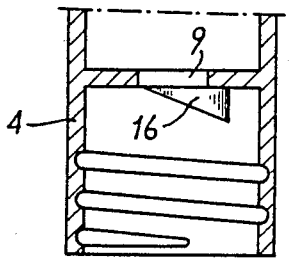
FIG. 5 is a cross-sectional view taken along line V—V of FIG. 4.
Figure 4:
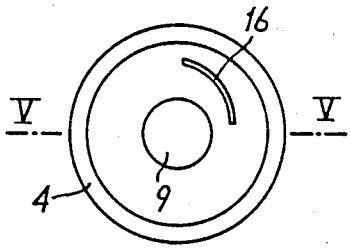
FIG. 4 is a cross-sectional view similar to FIG. 2 of an alternative embodiment.

The perforation member 10 can be constituted in many various ways. FIGS. 4 and 5 show, for example, that the perforation member 10 can be constituted by blades 16, for example of a helical shape. In such a case, a complete opening of the membrane 3 is produced by a rotation of about one turn of the cap 4. The perforation member 10 can also be formed directly from the inner wall of the cap 4 without providing a partition 8, which partition 8 has been shown only for facilitating the understanding of the operation. The perforation member 10 can also be partially annular.

It is advantageous that the cap 4 and the perforation member 10 will not create a head loss which could be detrimental in some uses and, for so doing, their shape and size are suitably determined by those skilled in the art.

Figure 6:
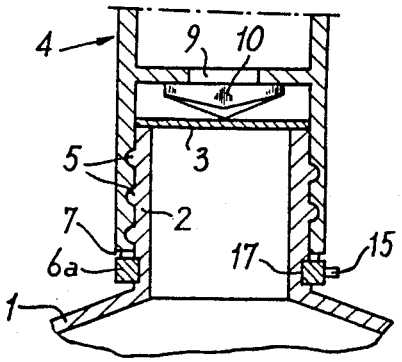
FIG. 6 is a cross-sectional view similar to FIG. 1, showing a development of the invention.

FIG. 6 illustrates a development of the invention according to which the removal band then shown at 6*a* is inserted in a retaining portion 17 of the container flank, for example in a groove of the flank. In this case, the removable band 6*a* constitutes moreover a pilfer-proof element in the shape of a ring preventing any removal of the cap 4 and preventing consequently any access to the membrane 3 as long as the removable and pilfer-proof band 6*a* has not been removed.

Figure 7:
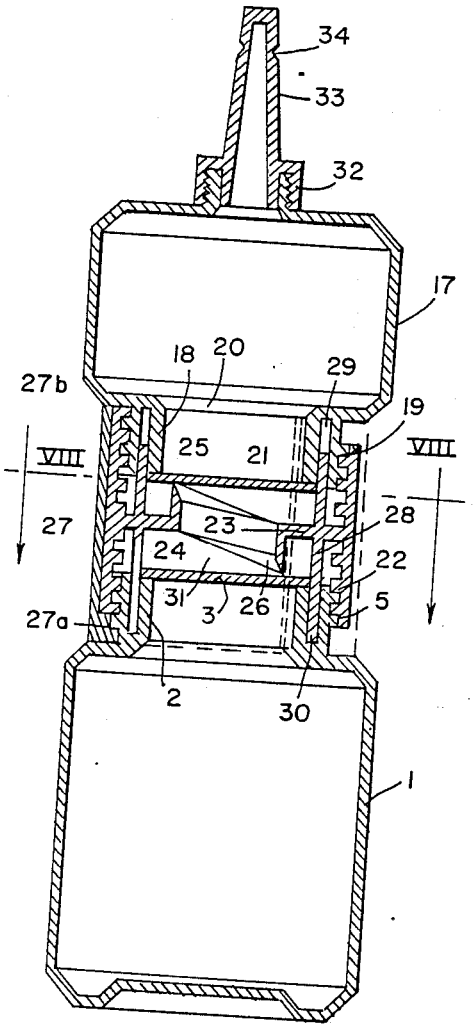
FIG. 7 is an cross-sectional elevation view of a variant of embodiment of the closing device of the invention.
Figure 8:
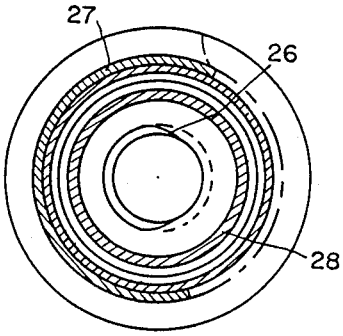
FIG. 8 is a transverse cross-sectional view taken along line VIII—VIII of FIG. 7.

In FIGS. 7 and 8, there is shown a container 1 similar to that of FIGS. 1–6, and which is further provided with an extra container 17, the container 17 forming, starting from its bottom, a base 18 having a shape similar to that of the neck 2 of the container 1. The base 18 comprises a screw thread 19 with a pitch reverse to that of screw thread 5 and it surround an opening 20 formed in the bottom of the container 17. The base 18 is closed by a membrane 21 similar to the hereabove described membrane 3.

The screw threads 5 and 19 of the containers 1 and 17 are connected together by a tapped ring 22, which however is not completely screwed onto these screw threads.

The ring 22 is provided in its median portion with a web 23 forming, or to which is connected, a perforator 24.

As shown in the drawings, the perforator 24 includes two opposite portions or sharp-edged blades 25 and 26, respectively turned toward the membranes 21 and 3. The perforator 24 is hollow.

The ring 22 to which is connected the perforator 24 is maintained by an immobilization member which, in this embodiment is constituted by a rider member 27 made of a resiliently deformable material and which is inserted between the containers 1 and 17 for forming a distance-piece therebetween.

FIG. 8 shows that the rider member 27 is applied against the outer wall of the ring 22, and FIG. 7 shows that the rider member 27 includes, at its ends, thicker portions 27*a* and 27*b* which overlap the ring 22 on either side by bearing respectively against the container 1 and the extra container 17, thereby locking the ring 22 in the position as shown.

The immobilization member 27 could be constituted in other ways than by the rider member 27, and for example by means of two collars of a flexible material and which could be broken, these collars occupying the position of the thicker portions 27*a* and 27*b*.

When collars are used as immobilization members, these collars are put in position prior to mounting of the ring 22 which is screwed until it comes in contact with each one of the collars.

In addition to the foregoing and as shown in FIG. 7, it is advantageous that the web 23 is provided, between the perforator 24 and the ring 22, with a sleeve 28 which is cylindrical and engaged in annular grooves 29 and 30 provided in a thickness of the base 18, on the one hand, and in a thickness of the neck 2 on the other hand. The sleeve 28 can thus connect the container 1 to the extra container 17.

By selecting conveniently the constituent material of the neck 2, base 18 and sleeve 28, it is possible to obtain a very good tightness for a chamber 31 bounded by the membranes 3 and 21.

The extra container 17 includes, on the other hand, a neck 32 on which is mounted a closing device 33, for example a cuttable end-piece having a zone of lesser resistance 34, as shown by way of example. Any other desired closing device known in the art could also be used.

As it is apparent from the foregoing, when one wishes to use the products contained in the containers 1 and 17, one removes the rider member 27 or other immobilization member or members, thereby making the ring 22 free to rotate.

By rotating the ring 22, an effect is to drive in rotation to a same extent the perforator 24 which is connected thereto by the web 23. At the same time, the ring 22 which is screwed on the screw threads 5 and 19 of the containers 1 and 17 brings these containers close to each other so that the cutting portions 25 and 26 of the perforator 24 will cut through the membranes 3 and 21.

The inside of the containers 1 and 17 being set into communication, this allows mixing the products which were contained in each of the containers 1 and 17. The sleeve 28 provides for a perfect tightness between the inside of the two containers 1 and 17 since, when the cutting of the membranes 3 and 21 is completed, the sleeve 28 can drive-in more completely within the grooves 29 and 30.

Advantageously, it is possible to shake the two connected containers in order to thoroughly mix together the products contained therein.

Finally, the closing device 33 is open, thereby permitting to use the mixed products.

The containers 1 and 17 can be manufactured in many different materials, for example in polyvinylchloride or polyethylene, or even glass. One of the container can be manufactured in one material and the other container in a different material.

The cutting portions 25 and 26 of the perforator 24 can be of the same material as the perforator-web-sleeve and ring assembly which is advantageously manufactured integrally by injection or any other means known in the art.

The cutting portions 25 and 26 can possibly be serrated in order to facilitate cutting of the membranes 3 and 21.

The invention is not limited to the embodiments shown and described in detail since various modifications can be carried out thereto without departing from the scope of the invention as shown in the appendent claims. Particularly, when a sleeve 28 is not provided, the device can connect two ordinary containers via their respective necks.

What is claimed is:

1. A closing device for a container in which a cap is put in position on a neck of the container, said neck defining a mouth sealed by a membrane, said cap comprising a side wall surrounding said neck and engagement means for engaging the neck of said container and opening and closing said container, a perforation member mounted in the vicinity of said membrane and carried by a partition of the cap, said partition having at least one hole therethrough, said perforation member being provided for folding back said membrane toward an inner surface of said neck side wall, and control means for controlling the position of said perforation member so that said perforation member occupies a first position in which it cannot act on the membrane and at least a second postion in which said membrane is broken and folded back by said perforation member in order to provide free communication between said container and inside of said cap.

2. The device as set forth in claim 1, wherein the perforation member is made of an S-shaped blade having a point member and slanting edges.

3. The device as set forth in claim 1, wherein the perforation member is made of a helical-shaped blade.

4. The device as set forth in claim 1, wherein the perforation member has a width at most equal to inner width of the neck of said container.

5. The device as set forth in claim 1, wherein the cap comprises a cover.

6. The device as set forth in claim 1, wherein the cap comprises a cuttable end-piece.

7. The device as set forth in claim 1, wherein said control means comprises a removable band abutting against the container and determining a first position for the cap, which corresponds to said first position for the perforation member.

8. The device as set forth in claim 7, wherein the removable band which determines the first position for the cap with respect to the container comprises a pilferproof ring.

9. The device as set forth in claim 7, wherein said engagement means comprise screw threads correspondingly provided on an outer wall of said neck and on an inner wall of said cap.

10. The device as set forth in claim 1, further comprising a ring partially screwed onto the neck of said container and on a base of an extra container provided for containing a product different from that provided to be contained in said container, at least one removable immobilization member for securing said ring against motion prior to use of the products contained in the container and in the extra container.

11. The device as set forth in claim 10, wherein a base of the extra container is closed by a membrane and communicates with inside of the extra container, a perforator with two cutting blades being further provided for cutting simultaneously the membranes of said container and said extra container.

12. The device as set forth in claim 11, wherein the perforator is hollow and is connected to the ring via a web supporting the perforator.

13. The device as set forth in claim 12, wherein the web connecting the perforator to the ring carries a sleeve having ends engaged within annular grooves respectively formed in the base and in the neck.

14. The device as set forth in claim 13, wherein the sleeve is connected to the neck and to the base in a tight manner.

15. The device as set forth in claim 10, wherein the immobilization member for the ring is made of a member forming a distance-piece between the containers.

16. The device as set forth in claim 10, wherein the immobilization member includes thicker portions interposed between ends of the ring and said container and said extra container.

17. The device as set forth in claim 10, wherein the extra container is provided with a neck and with a closing device.

* * * * *